US005649681A

United States Patent [19]

Faye

[11] Patent Number: 5,649,681

[45] Date of Patent: Jul. 22, 1997

[54] DRAIN TROUGH MOUNTING APPARATUS AND METHOD OF MANUFACTURING SAME

[76] Inventor: Donald F. Faye, 7129 South Dr., Richmond, Va. 23225

[21] Appl. No.: 535,930

[22] Filed: Sep. 28, 1995

[51] Int. Cl.[6] ..... E04D 13/072

[52] U.S. Cl. ..... 248/48.1; 248/48.2; 248/292.13

[58] Field of Search ..... 248/48.1, 48.2, 248/291.1, 292.13, 544, 247, 240.4, 242; 52/11, 15

[56] References Cited

U.S. PATENT DOCUMENTS

| | | | |
|---|---|---|---|
| 538,108 | 4/1895 | Freeze . | |
| 945,762 | 1/1910 | Dielman | 248/292.13 |
| 1,552,130 | 9/1925 | Fortwengler | 248/292.13 |
| 1,566,284 | 12/1925 | Rachlin | 248/48.1 |
| 1,635,871 | 7/1927 | Wilson | 248/48.1 |
| 1,661,192 | 3/1928 | Nelson | 248/240.4 X |
| 3,096,063 | 7/1963 | Nygren | 248/292.13 |
| 4,014,074 | 3/1977 | Faye . | |
| 4,072,285 | 2/1978 | Greenwood . | |
| 4,199,121 | 4/1980 | Le Febvre . | |
| 4,309,792 | 1/1982 | Faye . | |
| 4,311,292 | 1/1982 | Deason . | |
| 4,411,108 | 10/1983 | Kerester . | |
| 4,413,449 | 11/1983 | Faye . | |
| 4,669,232 | 6/1987 | Wyatt . | |
| 4,745,657 | 5/1988 | Faye . | |
| 4,884,775 | 12/1989 | Fischer, Jr. | 248/242 X |
| 5,127,133 | 7/1992 | Brucker . | |
| 5,146,718 | 9/1992 | Baskett . | |
| 5,184,435 | 2/1993 | Sherman . | |
| 5,274,965 | 1/1994 | Jackson . | |
| 5,317,843 | 6/1994 | Sheehan . | |
| 5,335,460 | 8/1994 | Smith, Jr. . | |
| 5,357,719 | 10/1994 | Lewis . | |
| 5,417,015 | 5/1995 | Coyne | 248/48.2 X |

*Primary Examiner*—Derek J. Berger
*Attorney, Agent, or Firm*—Joseph S. Presta

[57] ABSTRACT

An apparatus for connecting a drain trough to a building, including a mounting bracket having an elongated mounting portion and a support portion extending outwardly from a side edge of the mounting portion, the support portion including a first portion which extends upwardly along at least a portion of the side edge and a second portion which extends horizontally from a lower portion of the side edge. The apparatus further includes a harness device and a hinge device for hingedly connecting the mounting bracket with the harness device, wherein the harness device is operable to rotate between a first position wherein the drain trough is operable to receive water therein, and a second position in which the drain trough is inverted for cleaning. The harness device includes an elongated base portion, a connection portion extending downwardly from a side edge of the base portion for connecting the harness device to the mounting bracket, an upwardly extending tab member at a forward edge of the base portion, a rear portion extending upwardly from a rear edge of the base portion, and an overhead member extending forwardly from an upper portion of the rear portion. A method of making a plurality of the mounting apparatuses is provided wherein a plurality of mounting brackets and harness devices are stamped from rectangular sheets of material in a manner which minimizes wasted material.

21 Claims, 6 Drawing Sheets

DRAIN TROUGH MOUNTING APPARATUS AND METHOD OF MANUFACTURING SAME

BACKGROUND OF THE INVENTION

The present invention relates to a hinged mounting apparatus for a drain trough or gutter, and, more particularly, to an improved mounting apparatus which enables a gutter to be rotated to an inverted position for causing debris collected therein to fall therefrom.

Drain troughs, also known as gutters, are commonly used on buildings to collect rain water flowing from sloped roofs, and to direct the collected water away from the building. Gutters prevent water from flowing over building entrances, prevent soil erosion around buildings and help prevent water damage to building foundations and basements.

One problem associated with gutters is the tendency of leaves and other debris from trees or the like to collect within the gutter. Once a significant amount of debris collects in a gutter, the gutter becomes clogged and can no longer operate in its intended manner. When the gutter is clogged, rain water will simply overflow out of the gutter and down the side of the building, thereby defeating the original purpose behind installing a gutter system on the building. Moreover, rot and mildew damage can occur when rain water is allowed to flow down the side of a building.

Another problem can occur when adverse weather conditions cause ice and/or snow to accumulate in the gutter, thereby preventing water from properly draining through the gutter system. In addition, the weight of excess snow or ice in a gutter may damage the gutter system by causing the gutter to become deformed or detached from the building.

As a result of the above-mentioned problems associated with gutters, it is necessary to periodically clean unwanted debris and other material from the gutter. Traditionally, debris is removed from gutters by hand, or using a water hose, with the help of a ladder to reach the gutter. Another method of reaching a gutter for cleaning is to gain access to the roof of the building through a window or the like. Obviously, both of these methods are burdensome, dangerous and time-consuming ways of cleaning gutters. As a result of the difficulties in cleaning gutters, various devices have been introduced in the past which enable a gutter to be rotated to an inverted position for cleaning, without the use of a ladder or the need to stand on the roof adjacent the gutter. By inverting the gutter, unwanted materials simply fall therefrom, and a water hose can be used from a position on the ground to wash out the gutter. Once cleaned, the gutter can then be rotated back to its operating position, thereby greatly simplifying a gutter-cleaning operation.

Examples of rotatable gutter systems which simplify the cleaning thereof are shown in U.S. Pat. Nos. 4,745,657, 4,309,792, 5,184,435, and 5,317,843, as well as numerous other patents. While these and other similar devices work satisfactorily for their intended purpose of simplifying gutter cleaning, they also have several disadvantages. Some of these disadvantages are that the devices are expensive to manufacture, complicated to install and operate, do not securely maintain the gutter in its desired position, are subject to disconnection from the gutter, and are not strong and durable enough for long-term use without replacement. Further, many of the devices have a pivot point for rotating the gutter located significantly out in front of the gutter, thereby causing a large rotational arch of operation which may interfere with or prevent the gutter from being installed in an optimal position on the building for catching rain water. In other words, the location of the pivot point may require that the gutter be mounted significantly below the edge of the roof, so that the gutter does not hit the roof when being rotated to the inverted position for cleaning. The pivot point is usually significantly forward of the gutter to prevent wind from accidentally dumping the gutter over into the inverted position. Such accidental dumping by wind is a problem with many prior art hinged gutter systems.

Another disadvantage with the prior art devices is that they often allow water to drip behind the gutter and down the side of the building. Still another disadvantage is that, when a gutter is being installed on a building with a plurality of hinged support devices connected on a length of gutter, the devices tend to dig into the facia of the building, thereby complicating the installation process, and scraping paint off or damaging the facia. In addition, the prior art devices do not actively aid in holding the gutter in both the upright and inverted positions, for simplifying the transition of the gutter from an upright and inverted position, and vice versa. Another disadvantage is that the gutter tends to slam into the gutter downspout when the gutter is inverted for cleaning, thereby damaging the gutter and/or downspout. Moreover many of the prior art devices are bulky and have an unsightly appearance after installation when viewed from below.

Therefore, a need exists for an improved gutter mounting apparatus which does not suffer from the disadvantages associated with the prior art. The new and improved gutter mounting apparatus of the present invention meets this need.

SUMMARY OF THE INVENTION

Accordingly, it is a primary object of the present invention to provide an improved gutter mounting apparatus which is cheaper to manufacture and more efficient in operation.

A more particular object of the instant invention is to provide an improved gutter mounting apparatus which can be stamped out of flat sheets of material, such as aluminum, and bent to the desired shape to construct the gutter mounting apparatus.

Another object of the invention is to provide an improved gutter mounting apparatus which is strong, lightweight and durable.

Another object of the invention is to provide an improved gutter mounting apparatus which is easier to install than prior art devices.

A further object of the invention is to provide an improved gutter mounting apparatus which has a relatively small rotational arch of operation.

Yet another object of the invention is to provide an improved gutter mounting apparatus which is less susceptible to accidental dumping by wind than the prior art devices.

Still another object of the invention is to provide an improved gutter mounting apparatus which actively operates to maintain the gutter in both the upright position and the inverted position depending on the angle of rotation thereof.

Another object of the invention is to provide an improved gutter mounting apparatus which securely holds the gutter when the gutter is in both the upright and inverted positions.

A further object of the invention is to provide an improved gutter mounting apparatus which spreads the gutter open to handle additional volumes of water.

Yet another object of the invention is to provide a improved gutter mounting apparatus which prevents water from flowing behind the gutter when installed on a building.

Still another object of the invention is to provide an improved gutter mounting apparatus which prevents the gutter from slamming into and damaging the gutter downspout when the gutter is rotated to the inverted position for cleaning.

A further object of the instant invention is to provide an improved gutter mounting apparatus which easily slides along the facia of the building when being installed and does not tend to dig into the facia when sliding thereon.

Yet another object of the invention is to provide an improved gutter mounting apparatus which is not unsightly once installed when viewed from below.

Another object of the instant invention is to provide an improved method of manufacturing a gutter mounting apparatus, which method enables a plurality of similar mounting apparatuses to be made out of a sheet of material with a minimum amount of wasted material.

A further object of the instant invention is to provide an improved method of manufacturing a gutter mounting apparatus, wherein the constituent parts thereof are capable of being stamped from flat sheets of suitable material, such as aluminum.

These and other objects and advantages are achieved by the instant invention, which provides an apparatus for connecting a drain trough to a building, including a mounting bracket having an elongated mounting portion with means for connecting the mounting bracket to the building in a generally vertical position, and a support portion extending outwardly from a side edge of the mounting portion, the support portion including a first portion which extends upwardly along at least a portion of the side edge and a second portion which extends horizontally from a lower portion of the side edge. The apparatus further includes a harness device including means for connecting the harness device to the drain trough, and means for hingedly connecting the mounting bracket with the harness device, wherein the harness device is operable to rotate between a first position wherein the drain trough is operable to receive water therein, and a second position in which the drain trough is inverted for cleaning.

In accordance with another aspect of the invention, the mounting portion and the support portion of the mounting bracket are integrally formed from a flat blank, wherein the side edge is defined by a bend between the mounting portion and the support portion. Preferably, the mounting portion includes an upper end portion which is bent outwardly in a manner which defines a skid, which skid simplifies installation and prevents the mounting portion from digging into the facia of the building on which the apparatus is used.

In accordance with another aspect of the invention, the apparatus includes biasing means connected between the mounting bracket and the harness device for selectively biasing the harness device to the first position or to the second position as a function of an angle of rotation of the harness device relative to the mounting bracket.

In accordance with a further aspect of the invention, the harness device includes an elongated base portion, a connection portion extending downwardly from a side edge of the base portion for connecting the harness device to the mounting bracket, an upwardly extending tab member at a forward edge of the base portion, a rear portion extending upwardly from a rear edge of the base portion, and an overhead member extending forwardly from an upper portion of the rear portion, wherein the base portion, rear portion and overhead portion cooperate to hold the drain trough within the harness device.

In accordance with yet another aspect of the invention, the harness device is constructed such that the overhead portion extends over the rear wall and under an inner lip on the front wall, and the overhead portion includes a hook which is operable to connect to the inner lip of the front wall.

In accordance with a further aspect of the invention, the tab portion is constructed and arranged to stop the harness device from rotating beyond the second position by contacting the mounting bracket, wherein the second position is defined such that, when a drain trough is positioned within the apparatus and the harness device is in the second position, the front wall of the drain trough is in a substantially vertical position, thereby preventing the drain trough from damaging the downspouts when being cleaned.

In accordance with still another aspect of the invention, the harness device is operable to bend a rear wall of the drain trough rearwardly towards the mounting portion of the mounting bracket to increase a water volume capacity of the drain trough and prevent water from flowing behind the drain trough.

In accordance with a further aspect of the invention, a method of easily and economically making a plurality of the mounting apparatuses is provided, wherein a plurality of mounting brackets and harness devices are stamped from rectangular sheets of material, respectively, in a manner which minimizes wasted material. The mounting bracket is stamped using a nested herring-bone pattern, and the harness member is stamped using an alternating orientation pattern, wherein each adjacent pair of harness devices uses a rectangular section of the sheet of material.

BRIEF DESCRIPTION OF THE DRAWINGS

Other objects, advantages and aspects of the subject invention will become apparent from a study of the following specification when viewed in light of the accompanying drawings, in which.

DETAILED DESCRIPTION

Figure 1:
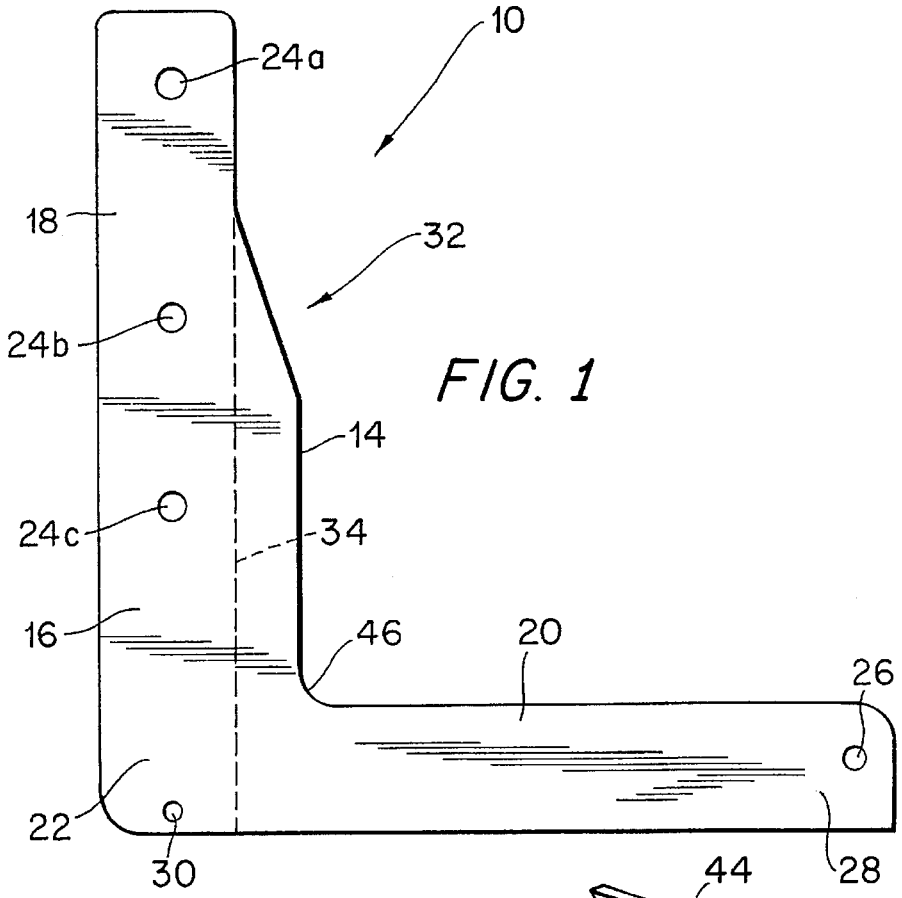
FIG. 1 shows a front elevational view of the flat blank from which the mounting bracket of the instant invention is made.

Referring now to the drawings, wherein like reference numerals designate similar parts throughout the various views, and more particularly to FIG. 1, there is shown a preferred embodiment of the mounting bracket blank 10 used in making the mounting bracket 12 of the instant invention. The blank 10 is preferably stamped from a flat sheet of suitable material, such as aluminum or the like. The blank 10 has a generally L-shaped configuration with an inner edge 14 and an outer edge 16 defining an elongated first portion 18 and an elongated second portion 20, wherein the second portion 20 extends at a right angle from the lower portion 22 of the first portion 18. A plurality of mounting holes 24*a*, 24*b* and 24*c* are stamped along the length of the first portion 18. A harness connection hole 26 is stamped in an outer end 28 of the second portion, and a spring connection hole 30 is stamped in the lower portion 22 of the first portion 18. The purpose of the spring connection hole 30 and the harness connection hole 26 will be explained in more detail below. Preferably, the mounting bracket blank 10 has a stepped inner edge 14 formed by cutting or punching away an upper inner portion 32 of the first portion 18. The inner corner 46 of the blank 10 preferably is curved rather than pointed, to give the mounting bracket 12 additional support strength.

Figure 2:
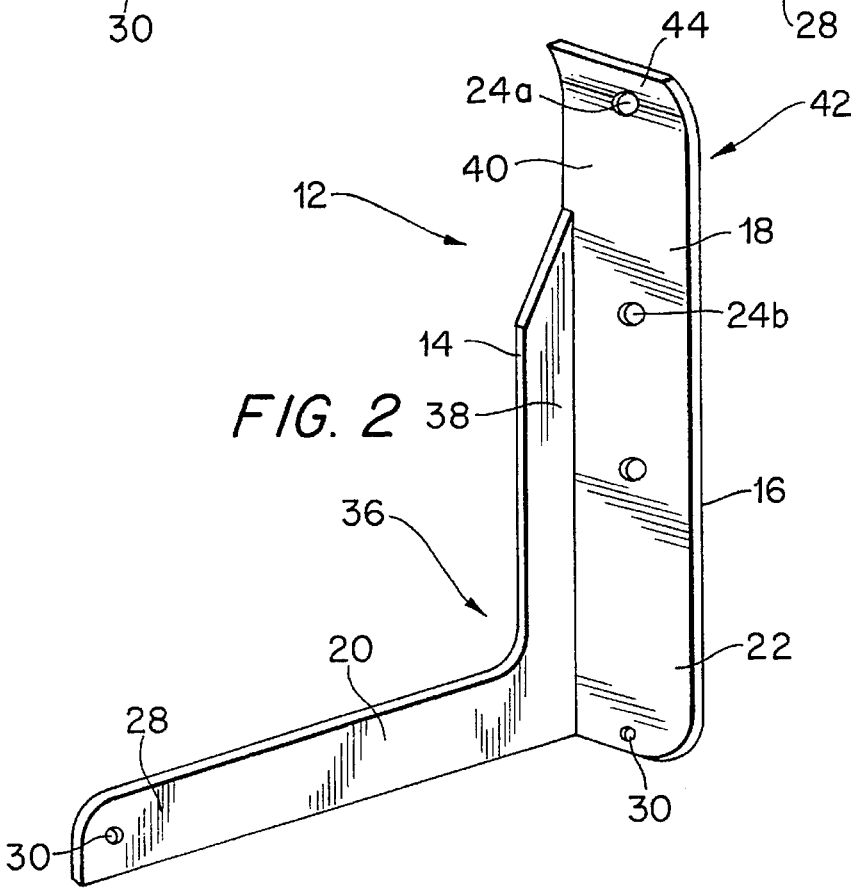
FIG. 2 shows a perspective view of the mounting bracket constructed from the blank of FIG. 1, in accordance with the instant invention.

As shown in FIG. 2, the first portion 18 of the mounting bracket blank 10 is bent at a right angle along the length thereof, and preferably along a line 34 defined by the stepped inner edge 14, to form the mounting bracket 12 of the instant invention. Once bent, the first portion 18 of the blank 10 becomes a mounting portion of the bracket 12, and the mounting holes 24*a*–24*c* enable the mounting bracket 12 to be connected by screws or the like to the facia of a building in a generally vertical position, when using the bracket to install a gutter on a building. The bending also defines a support portion formed by the second portion 20 of the blank 10 and the bent portion of the first portion 18. As a result, the support portion 36 includes a first portion 38 which extends upwardly along the side edge 40 of the mounting portion 18, and the second portion 20 extending outwardly therefrom. Preferably, an upper end portion 42 of the mounting portion 18 is bent or curved outwardly to define a skid 44, which skid prevents the mounting bracket 12 from digging into and getting caught on the facia of the building when sliding into proper position thereon for installation. In other words, the skid enables the bracket to slide smoothly along the facia during installation.

Figure 3:
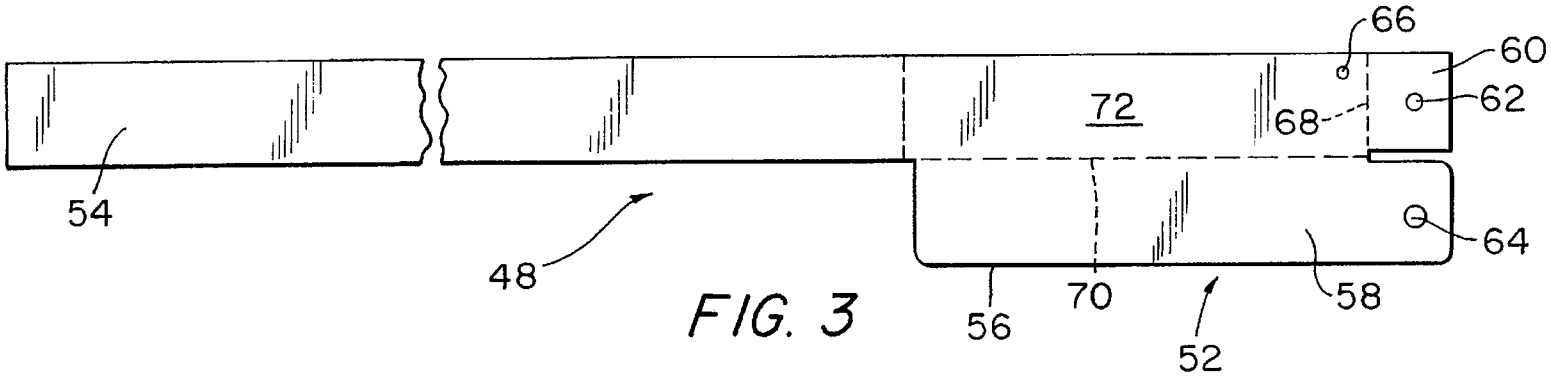
FIG. 3 shows a front elevational view of a flat blank from which the gutter harness device of the instant invention is constructed.

Referring now to FIG. 3, there is shown a preferred embodiment of the harness blank 48 used to make the harness device 50 of the instant invention. The harness blank 48 is punched from a flat piece of suitable material, such as aluminum. The harness blank 48 includes a generally rectangular first part 52 and an elongated second part 54 extending from the first part 52, such that a stepped side edge 56 is present on the harness blank 48. The end portion of the first part 52 is bifurcated and defines a connection portion 58, a tab portion 60 and a base portion 72. The tab portion 60 includes a drain trough attachment hole 62, and the connection portion 58 includes a mounting bracket connection hole 64. A spring connection hole 66 is also provided in the first portion 52 of the harness blank 48.

Figure 4A:
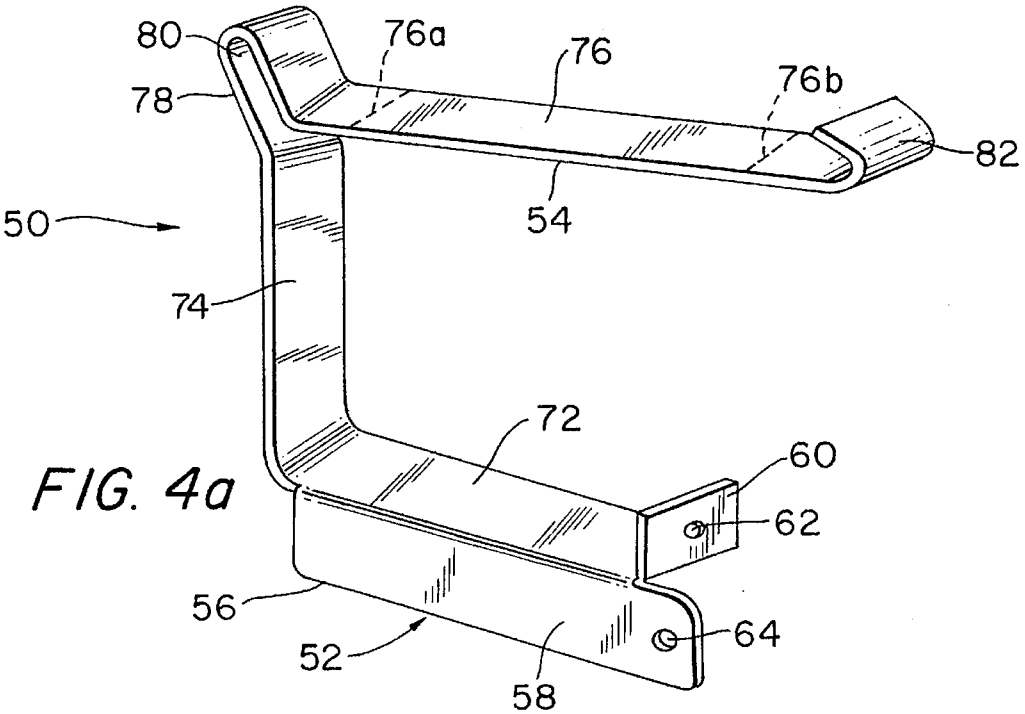
FIG. 4*a* shows a perspective view of the harness device constructed from the blank of FIG. 1, in accordance with the instant invention.

As shown in FIG. 4*a*, the harness blank 48 is bent to form the harness device 50 of the present invention. In particular, the tab portion 60 is bent upwardly along a transverse line 68 and the connection portion 58 is bent downwardly along a longitudinal line 70, with respect to the base portion 72. The second part 54 of the harness blank 48 is bent upwardly and forwardly into a shape which will receive a gutter therein. Preferably, the second part 54 is bent to define a rear portion 74 extending upwardly from a rear edge of the base portion 72, and an overhead member 76 extending forwardly from an upper portion of the rear portion 74. The base portion 72, tab portion 60, rear portion 74 and overhead portion 76 cooperate to securely hold a drain trough within the harness device 50. Preferably, the upper part 78 of the rear portion 74 is bent rearwardly, and the rear portion 74 and overhead portion 76 together define a rearwardly angled channel 80 which is operable to bend the rear wall of the gutter rearwardly when inserted therein, to increase a water volume capacity of the gutter and to prevent water from flowing behind the rear wall of the gutter. In accordance with a preferred embodiment of the instant invention, the forward end of the overhead portion 76 is bent to form a hook 82 which is operable to connect to an inner lip of the front wall of a gutter when inserted therein.

While the stamped embodiment of the harness device is preferred, the harness device 50 may be an extruded member (not shown) having a similar shape to that of FIG. 4*a* or similar to that shown in U.S. Pat No. 4,745,657. If an extruded member is used, the forward end portion thereof should be bifurcated so as to straddle the support portion 20 of the mounting bracket 12, and the bifurcated end should have a hole therethrough which aligns with hole 26 on the support portion for receiving a pin which pivotally connects the mounting bracket and the harness member. In the extruded embodiment, the bifurcated end would replace the connection portion 58 on the stamped harness device 50.

Figure 4B:
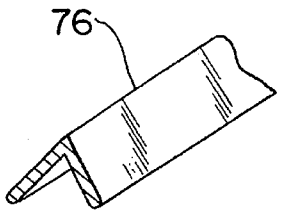
FIG. 4*b* shows a partial view of an alternative embodiment of the harness device of FIG. 4*a;*
Figure 5:
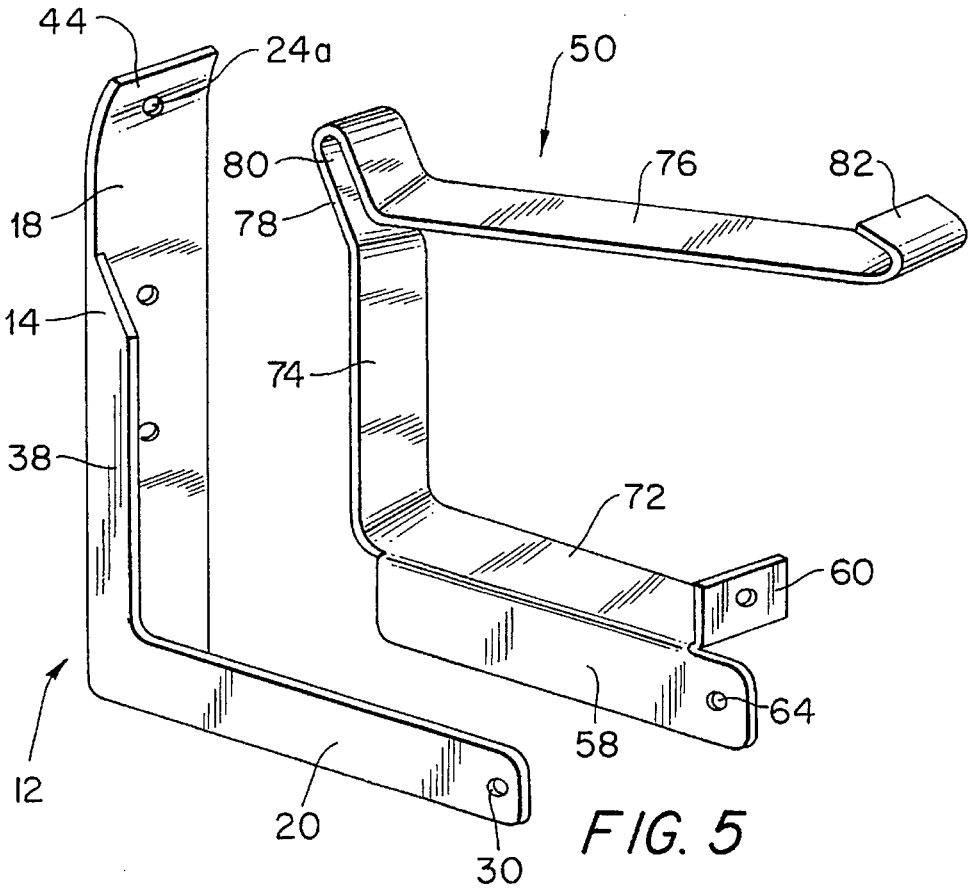
FIG. 5 shows an exploded view of the gutter mounting apparatus of the instant invention.
Figure 6:
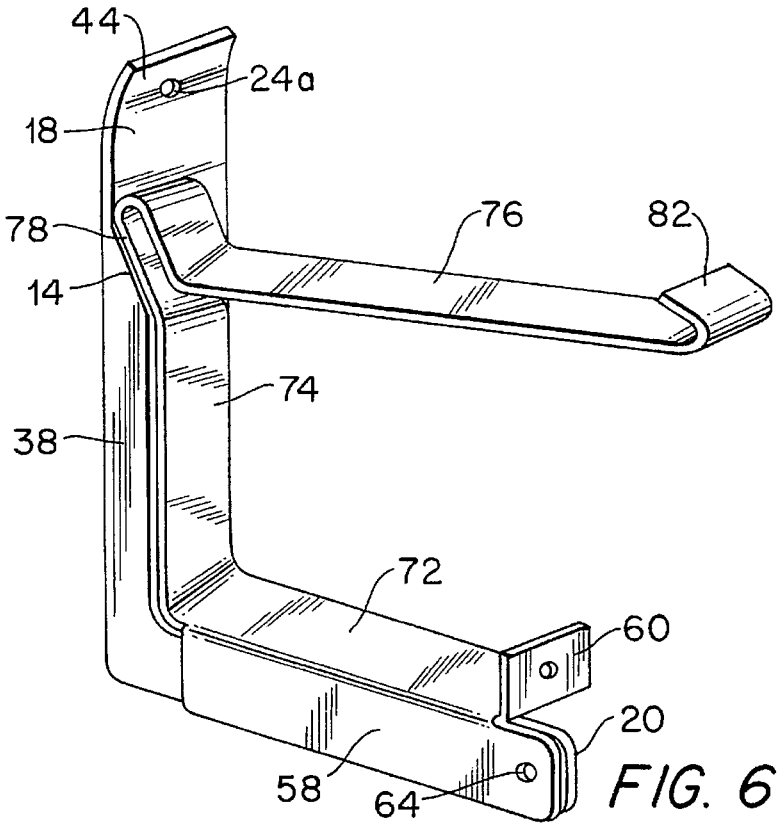
FIG. 6 shows the gutter mounting apparatus of FIG. 5 assembled in accordance with the instant invention and ready for use in mounting a gutter.

Referring now to FIG. 5, there is shown the mounting bracket 12 and the harness device 50 being placed into the nested relation of FIG. 6, to form a preferred embodiment of the gutter connection apparatus of the instant invention. When brought together, the base portion 72 of the harness member 50 rests on the support portion 20 of the mounting bracket 12. The support portion 20 of the mounting bracket 12 and the connection portion 58 of the harness device 50 are in adjacent parallel relation, such that the connection holes 30 and 64 on the mounting bracket and the harness device, respectively, are aligned with one another. The support portion 20 of the mounting bracket 12 may be bent to define an offset which prevents the support portion 20 and the connection portion 58 from rubbing together when rotated. Further, the angle of the stepped edge 14 on the mounting bracket corresponds to the angle of the upper part 78 of the rear portion 74 of the harness device 50. As shown in FIG. 4*b*, a part of the overhead portion 76 may, in an alternative embodiment, be bent in a manner which defines an inverted "V"-shaped cross-section to increase the strength thereof and to prevent water from splashing on the overhead portion 76 and over the gutter when entering the gutter from the roof of the building. The added strength obtained by bending the overhead portion 76 helps to prevent the overhead portion from deforming when, for example, a ladder is leaned on the gutter. Preferrably, the overhead portion 76 is bent in the inverted "V"-shape along the central area defined between the dotted lines 76*a* and 76*b* in FIG. 4*a* Alternatively, the overhead portion 76 may be provided with holes therein (not shown) to help prevent water from splashing thereon and over the gutter.

Figure 7:
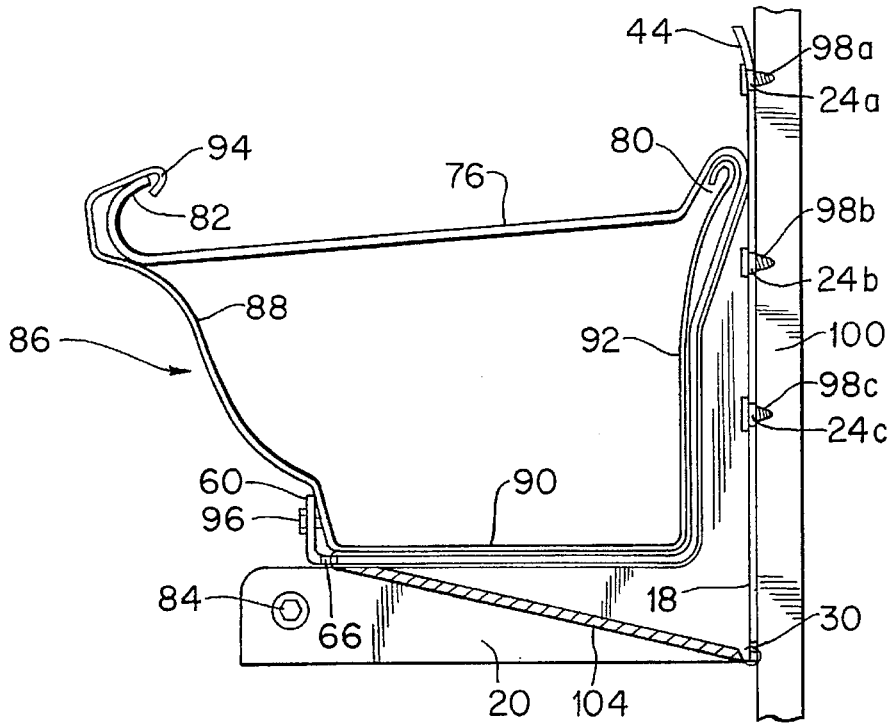
FIG. 7 shows the gutter mounting apparatus of FIG. 6 secured to the facia of a building and holding a gutter in an upright position.

As shown in FIG. 7, a pin 84 is inserted and secured within the aligned holes 30 and 64 on the mounting bracket 12 and the harness device 50, respectively, in order to hingedly connect the harness device 50 to the mounting bracket 12. The harness member 50 is operable to rotate between the first position, as shown in FIG. 7, wherein the gutter is upright and positioned to receive water flowing off the roof of a building, and a second position, shown in FIG. 8, wherein the gutter is inverted for cleaning. The gutter 86 has a front wall 88, a bottom wall 90 and a rear wall 92. The hook 82 on the overhead portion 76 of the harness member connects to the inner lip 94 on the front wall 88 of the gutter 86. The rear wall 92 of the gutter 86 is inserted into the rearwardly angled channel 80 formed by the harness member, which channel 80 operates to bend the rear wall 92 of the gutter 86 rearwardly towards the mounting portion 18 of the mounting bracket 12, in order to increase the water capacity of the gutter and to prevent water from flowing behind the rear wall 92 of the gutter 86. A fastener 96, such as a screw, connects the tab portion 60 of the harness member to the front wall 88 of the gutter 86.

In accordance with a preferred embodiment of the instant invention, the mounting bracket 12 includes a top hole 24*a* in a location on the mounting bracket which is above the harness device, so that the harness device does not block the hole 24*a*. This feature enables a screw 98*a* or other fastener to be inserted through the hole 24*a* when installing the bracket on the facia 100 of a building (not shown), while the harness device is in the first position of FIG. 7, thereby simplifying installation. Screws 98*b* and 98*c* can be inserted into the remaining holes 24*b* and 24*c*, when installing the apparatus, by rotating the harness device to the second position of FIG. 8, to enable access thereto. Preferably, the hole 24*a* is in the skid portion 44 of the bracket device 12, so that once the bracket is in the desired position the screw can be tightened into the facia 100, in a manner which causes the skid to be drawn flat against the facia 100.

Figure 8:
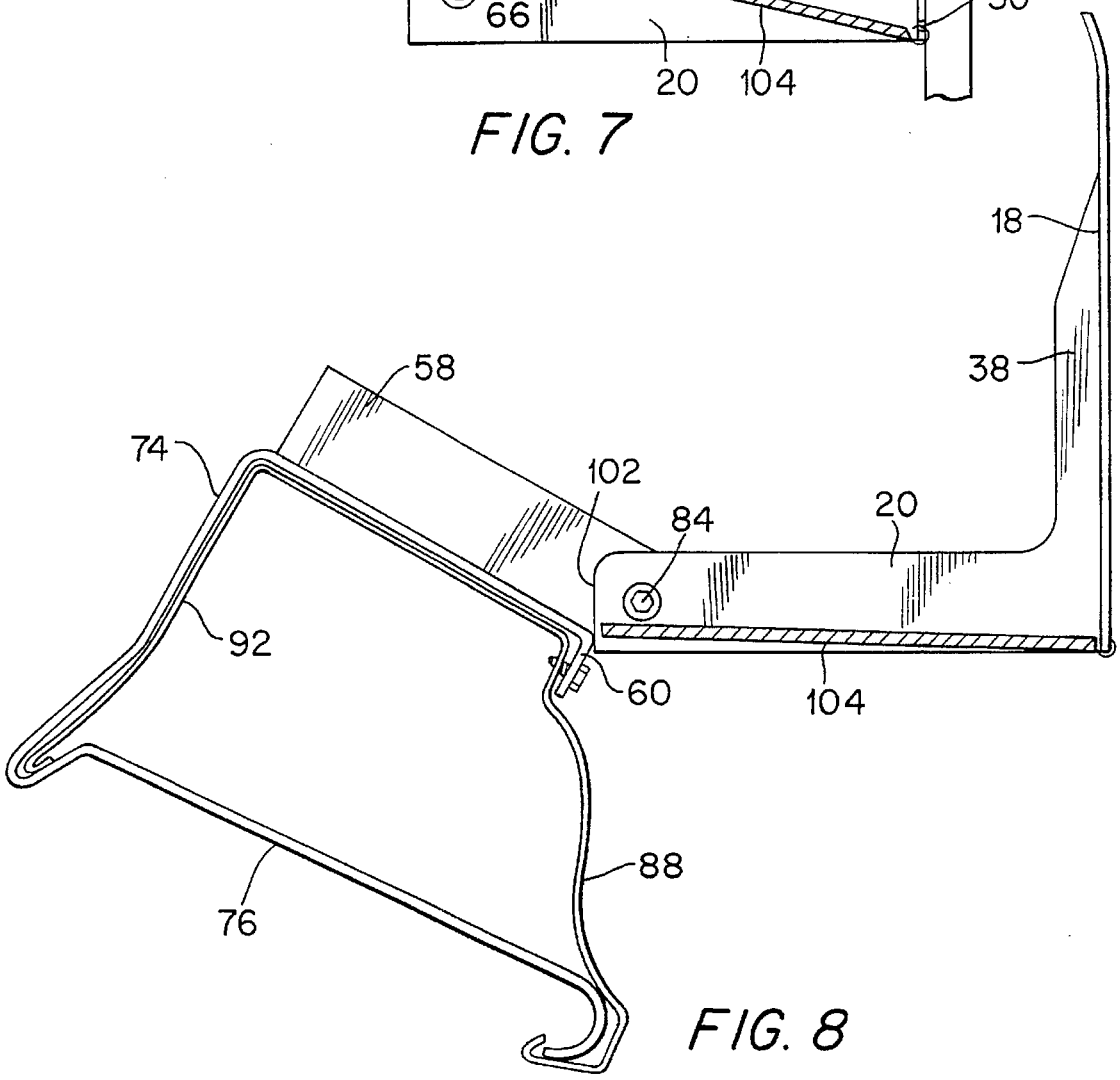
FIG. 8 shows the gutter mounting apparatus of FIG. 7 rotated to an inverted position for cleaning the gutter.

As shown in FIG. 8, the tab portion 60 of the harness device 50 contacts the forward edge 102 of the mounting bracket 12 and acts as a stop which limits the rotation of the harness device 50 to approximately between 130 and 150 degrees from the first position of FIG. 7. In accordance with a preferred embodiment of the instant invention, the tab portion 60 stops the rotation of the harness device in a position wherein the front wall 88 of the gutter 86 is in a substantially vertical position, thereby preventing the gutter 86 from slamming into the gutter downspouts (not shown), when rotated to the second position for cleaning.

Preferably, a spring 104, or other suitable biasing means, is connected at one end in the spring connection hole 30 of the mounting bracket 12 and at the other end in the spring connection hole 66 of the harness device 50, such that the spring acts to maintain or bias the harness device 50 in the first position, when the harness device 50 is in the first position or near thereto. In accordance with the instant invention, the spring 104 is positioned relative to the pivot point, defined by the pin 84, such that the spring 104 passes the pivot point when the harness device 50 is rotated a given number of degrees, which causes the spring to bias the harness device to the second position of FIG. 8. In other words, the spring 104 selectively biases the harness device 50 to either the first position or the second position depending on the angle of rotation of the harness device 50 relative to the mounting bracket 12. The spring 104 securely holds the gutter 86 in both the first and second positions, as well as helps with the transition between the first and second positions. One significant advantage of the spring 104 is that, when the gutter is in the second position, a hose can be used to spray the inside of the gutter for cleaning without causing the gutter to flip back to the first position. In addition, the spring 104 makes it much easier to rotate a long section of gutter supported by a plurality of the instant apparatuses to and from the first and second positions from a location on the ground with the use of a single long pole or rod. Once the gutter is rotated a certain number of degrees from the first or second position, the spring 104 assists in bringing the gutter to the desired position. The spring 104 also provides the advantage of not having to have the pivot point (pin 84) relatively far out in front of the gutter to keep the gutter from inadvertently rotating to the second position by the force of wind. The close-in pivot point of the present invention minimizes the arc of rotation of the harness device, and enables the gutter to be mounted close to the edge of the roof on the facia without the gutter hitting the roof when rotated.

In operation, a plurality of the gutter mounting apparatuses of the instant invention are used in spaced relation along the length of a gutter section, to hold the gutter section in the proper position on the building. The skids 44 have particular utility in preventing damage to the building facia and simplifying installation when a length of gutter having numerous mounting apparatuses connected thereon is being moved into the proper position on the building.

Figure 9:
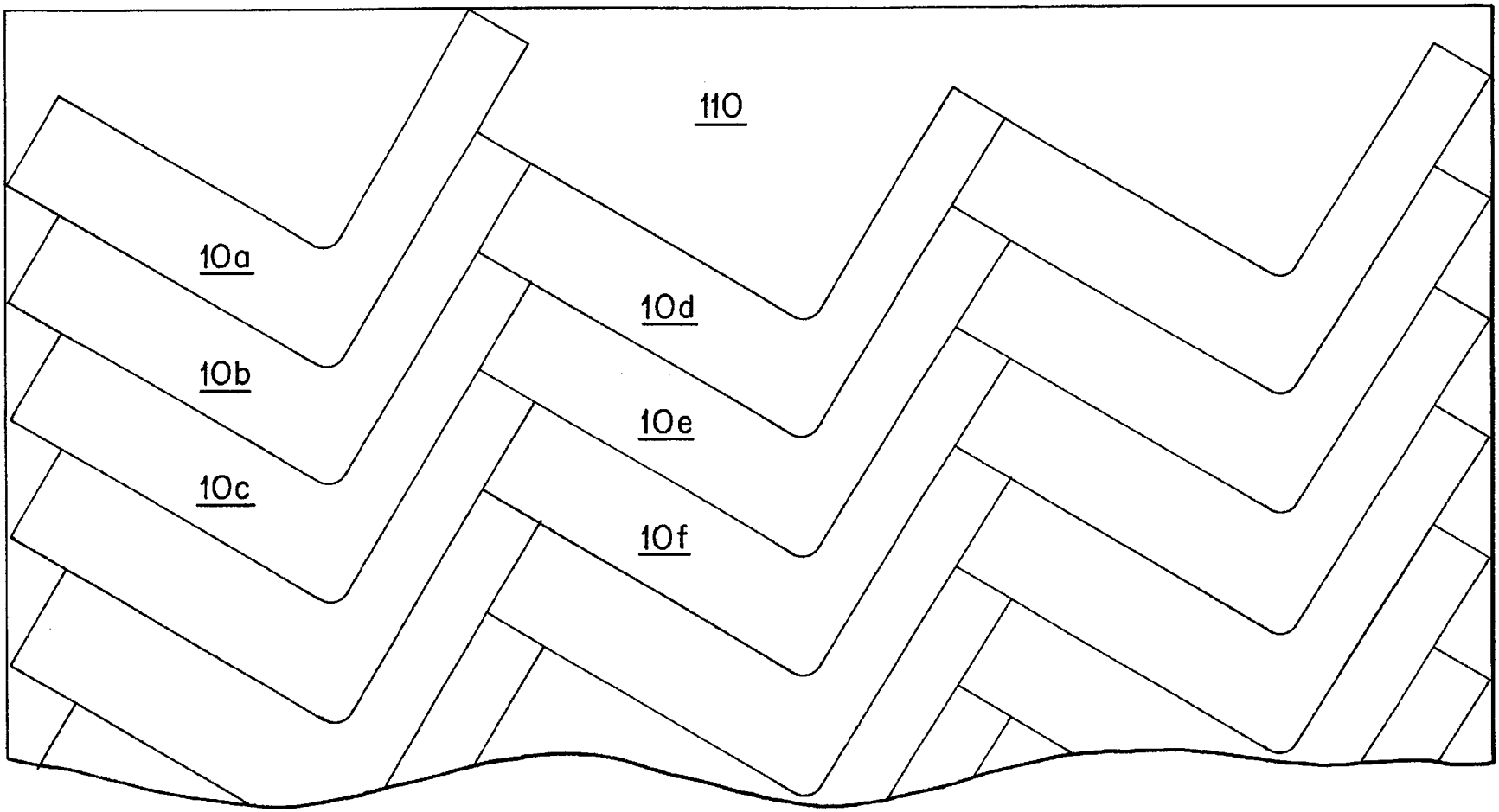
FIG. 9 shows a pattern for stamping a plurality of harness devices from a sheet of material, in accordance with the method of the instant invention.
Figure 10:
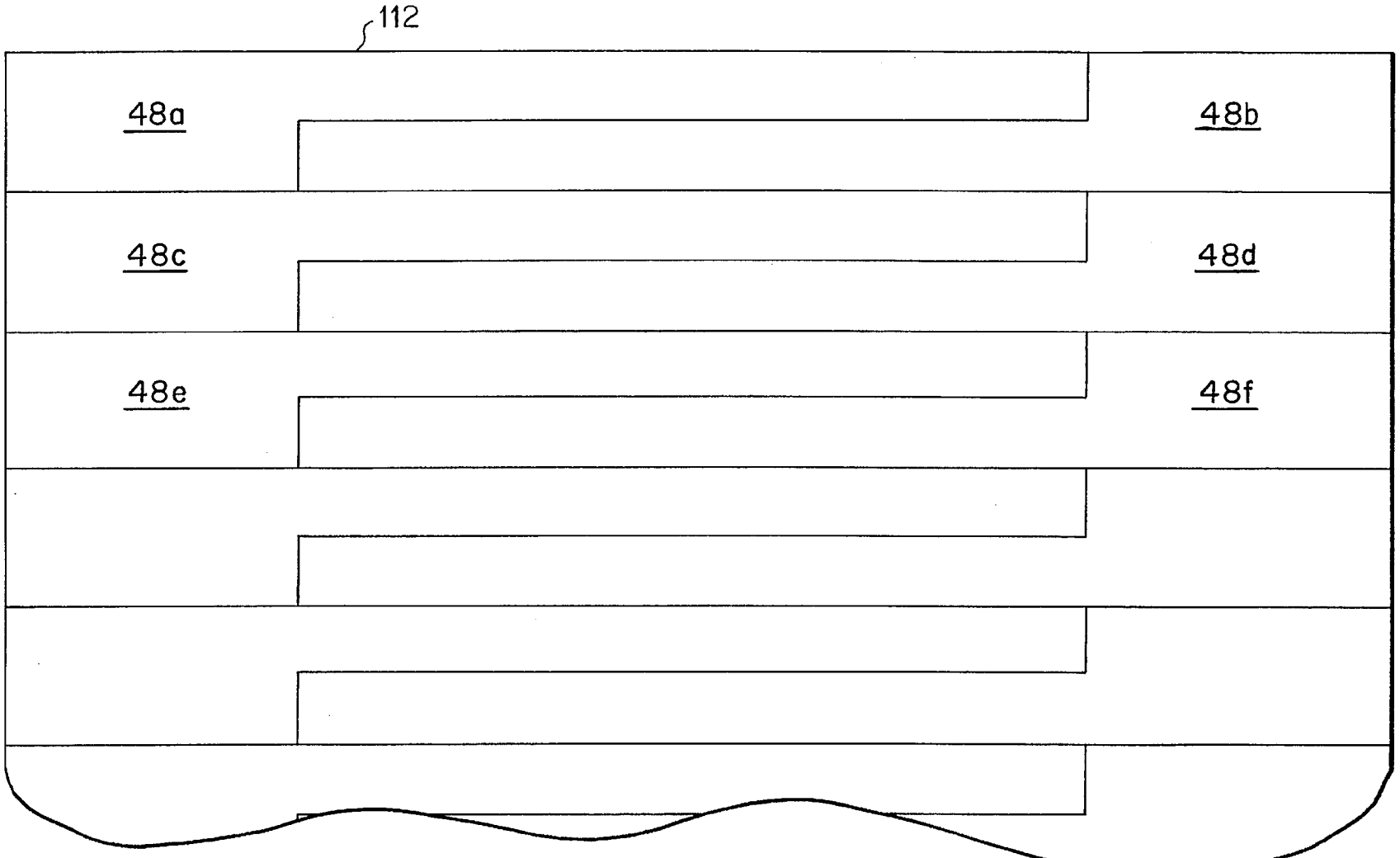
FIG. 10 shows a pattern for stamping a plurality of mounting brackets from a sheet of material, in accordance with the method of the instant invention.

In accordance with another aspect of the invention, a plurality of mounting bracket blanks 10*a*–10*f* are made by stamping the blanks from a rectangular sheet of material 110 in the nested, herring-bone pattern shown in FIG. 9. Using the herring-bone pattern shown in FIG. 9 to mass produce the mounting bracket blanks minimizes the amount of wasted material in the sheet 110. In accordance with the invention, a plurality of harness blanks 48*a*–48*f* are stamped from a rectangular sheet of material 112 in the alternating orientation pattern shown in FIG. 10, which eliminates any wasted material on the sheet 112.

As can be seen from the above description, the apparatus and method of the instant invention provides an improved gutter mounting apparatus which is cheaper and easier to manufacture, simple to install and provides easy and reliable operation.

While the preferred forms and embodiments of the invention have been illustrated and described, it will be apparent to those of ordinary skill in the art that various changes and modifications may be made without deviating from the inventive concepts and spirit of the invention as set forth above, and it is intended by the appended claims to define all such concepts which come within the full scope and true spirit of the invention.

What is claimed is:

1. An apparatus for connecting a drain trough to a building, comprising:

a mounting bracket having a mounting portion with means for connecting said mounting bracket to said building in a generally vertical position, and a support portion extending outwardly from a side edge of said mounting portion, said support portion having a generally L-shaped configuration defined by a first portion which extends upwardly along at least a portion of said side edge and a second portion which extends horizontally from a lower portion of said side edge;

a harness device including means for connecting said harness device to said drain trough; and means for hingedly connecting said mounting bracket with said harness device, wherein said harness device is operable to rotate between a first position wherein said drain trough is operable to receive water therein, and a second position in which said drain trough is inverted for cleaning.

2. An apparatus as defined in claim 1, wherein said mounting portion and said support portion of said mounting bracket are integrally formed from a flat blank, and further wherein said side edge is defined by a bend between said mounting portion and said support portion.

3. An apparatus as defined in claim 1, wherein said mounting portion includes an upper end portion which is bent outwardly in a manner which defines a skid.

4. An apparatus as defined in claim 3, wherein said means for connecting said mounting bracket to said building includes a plurality of holes in said mounting portion, and further wherein said plurality of holes includes a top hole in said upper end portion at a location thereon which extends above said harness device when said harness device is in said first position.

5. An apparatus as defined in claim 1, further comprising biasing means connected between said mounting bracket and said harness device for selectively biasing said harness device to said first position or to said second position as a function of an angle of rotation of said harness device relative to said mounting bracket.

6. An apparatus as defined in claim 5, wherein said biasing means comprises a spring.

7. An apparatus as defined in claim 1, wherein said harness device includes an elongated base portion, a connection portion extending downwardly from a side edge of said base portion for connecting said harness device to said mounting bracket, an upwardly extending tab member at a forward edge of said base portion, a rear portion extending upwardly from a rear edge of said base portion, and an overhead portion extending forwardly from an upper portion of said rear portion, wherein said base portion, said rear portion and said overhead portion cooperate to hold said drain trough within said harness device.

8. An apparatus as defined in claim 7, wherein said base portion, connection portion, tab portion, rear portion and overhead portion are integrally formed from a flat blank, and further wherein said side edge of said base portion is defined by a bend between said base portion and said connection portion.

9. An apparatus as defined in claim 7, said harness device being constructed such that said overhead portion is adapted to extend over a rear wall of said drain trough and under an inner lip of a front wall of said drain trough, said overhead portion including a hook portion which is operable to connect to the inner lip of the front wall.

10. An apparatus as defined in claim 7, wherein said tab portion is operable to stop said harness device from rotating beyond said second position by contacting said mounting bracket, wherein said second position is reached when said harness device is rotated approximately 130 to 150 degrees from said first position.

11. An apparatus as defined in claim 10, wherein said second position is defined such that, when a drain trough is positioned within said apparatus and said harness device is in said second position, a front wall of said drain trough is in a substantially vertical position.

12. An apparatus as defined in claim 7, wherein said harness device comprises means operable to bend a rear wall of said drain trough rearwardly towards said mounting portion of said mounting bracket to increase a water volume capacity of said drain trough and prevent water from flowing behind said rear wall.

13. An apparatus for connecting a drain trough to a building, comprising:

a mounting bracket including a mounting portion for connecting said mounting bracket to said building in a generally vertical position;

a harness device including an elongated base portion, a connection portion extending downwardly from a side edge of said base portion for connecting said harness device to said mounting bracket, an upwardly extending tab member at a forward edge of said base portion, a rear portion extending upwardly from a rear edge of said base portion, and an overhead portion extending forwardly from an upper portion of said rear portion, wherein said base portion, said rear portion and said overhead portion cooperate to hold said drain trough within said harness device, and further wherein said side edge of said base portion is defined by a right-angle bend between said base portion and said connection portion; and means for hingedly connecting said mounting bracket with said harness device, wherein said harness device is operable to rotate between a first position wherein said drain trough is operable to receive water therein, and a second position in which said drain trough is inverted for cleaning.

14. An apparatus as defined in claim 13, wherein said base portion, connection portion, tab portion, rear portion and overhead portion are integrally formed from a flat blank.

15. An apparatus as defined in claim 13, said harness device being constructed such that said overhead portion is adapted to extend over a rear wall of said drain trough and under an inner lip of a from wall of said drain trough, said overhead portion including a hook portion which is operable to connect to the inner lip of the front wall.

16. An apparatus as defined in claim 13, wherein said tab portion is operable to stop said harness device from rotating beyond said second position by contacting said mounting bracket, wherein said second position is reached when said harness device is rotated approximately 130 to 150 degrees from said first position.

17. An apparatus as defined in claim 16, wherein said second position is defined such that, when a drain trough is positioned within said apparatus and said harness device is in said second position, a front wall of said drain trough is in a substantially vertical position.

18. An apparatus as defined in claim 13, wherein said harness comprises means operable to bend a rear wall of said drain trough rearwardly towards said mounting portion of said mounting bracket to increase a water volume capacity of said drain trough and prevent water from flowing behind said rear wall.

19. An apparatus as defined in claim 13, wherein said overhead portion includes a central portion which is bent in a manner which defines an inverted "V"-shaped cross-section to prevent water from splashing thereon and over said drain trough.

20. An apparatus for connecting a drain trough to a building, wherein said drain trough has a front wall and a rear wall in spaced relation defining a given water volume capacity that can be held in said drain trough, said apparatus comprising:

a mounting bracket operable to be connected to said building in a generally vertical position;

a harness device including means for connecting said harness device to said drain trough, said harness device further including means for bending said rear wall rearwardly to increase said given water volume capacity when said harness device is connected to said drain trough; and means for hingedly connecting said mounting bracket with said harness device, wherein said harness device is operable to rotate between a first position wherein said drain trough is operable to receive water therein, and a second position in which said drain trough is inverted for cleaning.

21. An apparatus as defined in claim 20, further including biasing means connected between said mounting bracket and said harness device for selectively biasing said harness device to said first position or to said second position as a function of an angle of rotation of said harness device relative to said mounting bracket.

* * * * *